United States Patent [19]

Yamashita

[11] Patent Number: 4,601,259

[45] Date of Patent: Jul. 22, 1986

[54] DEVELOPING APPARATUS

[75] Inventor: Keitaro Yamashita, Saitama, Japan

[73] Assignee: Kentek Information Systems, Inc., Allendale, N.J.

[21] Appl. No.: 636,840

[22] Filed: Aug. 1, 1984

[30] Foreign Application Priority Data

Aug. 3, 1983 [JP] Japan ..... 58-142128

[51] Int. Cl.[4] ..... G03G 15/09

[52] U.S. Cl. ..... 118/658; 118/689; 355/3 DD

[58] Field of Search ..... 118/657, 658, 689

[56] References Cited

U.S. PATENT DOCUMENTS 4,499,169 2/1985 Haneda et al. ..... 118/657 X
4,514,480 4/1985 Wada et al. ..... 118/657

FOREIGN PATENT DOCUMENTS 117047 10/1976 Japan .
126944 11/1978 Japan .
96966 7/1980 Japan .
156859 12/1981 Japan .
211175 12/1982 Japan .
24151 2/1983 Japan .
57873 4/1983 Japan .
57874 4/1983 Japan .
99462 6/1984 Japan .
99463 6/1984 Japan .

*Primary Examiner*—Bernard D. Pianalto
*Attorney, Agent, or Firm*—Marmorek, Guttman & Rubenstein

[57] ABSTRACT

A developing apparatus develops an electrostatic latent image formed on the surface of an image retaining member into a visible image by the use of a developer including a magnetic carrier and a toner. The developing apparatus includes a rotatable non-magnetic sleeve retaining the developer, a permanent magnet member disposed in the non-magnetic sleeve and having a plurality of magnetic poles, a developer tank containing the developer, a toner tank containing the toner and having a toner outlet communicating with the developer tank and further having a toner replenishing movable member at the outlet, and a developer mixing movable member installed inside the developer tank. In the developer tank, a predetermined amount of the developer is contained which has previously been adjusted to a predetermined toner density. Further, the developing apparatus is constructed such that the whole of the developing apparatus is abandoned after the magnetic carrier has reached the end of its predetermined life.

2 Claims, 6 Drawing Figures

DEVELOPING APPARATUS

BACKGROUND OF THE INVENTION

1. Field of the Invention:

The present invention relates to a developing apparatus which develops an electrostatic latent image formed on the surface of an image retaining member into a visible image by the use of a developer including both a magnetic carrier and a toner.

2. Description of the Prior Art:

A typical conventional image forming system, such as an electrophotographic system or an electrostatic recording system, has at least a charging apparatus, an exposure apparatus and a developing apparatus which are disposed around an image retaining member having a photoconductive material layer or dielectric layer formed on the surface thereof. In the case where the system includes a transfer process, the system is further provided with a transfer apparatus for transferring a developed image to a transfer sheet and a cleaning apparatus for removing the toner remaining on the surface of the image retaining member after transfer has been effected. In addition, the system has a fixing apparatus for obtaining a final image.

In the above-described image forming system, it is common to use a developing apparatus of the type, from the viewpoint of the quality of the developed image, wherein a mixed powder of a magnetic carrier (referred to simply as "carrier", hereinafter) and a toner is employed as a developer, and a magnetic brush is formed on a non-magnetic sleeve having a permanent magnet member therein to brush the surface of the image retaining member, thereby to develop an electrostatic latent image into a visible image. In this type of developing apparatus, the developer which has been used in one developing operation is once scraped off the non-magnetic sleeve and is subjected to detection of the toner density therein before the developer is used again in a subsequent developing operation. The developer is then mixed with an amount of the toner which is replenished in accordance with the detected toner density and is supplied for development again. In such case, when the developer is used for a long period of time, the carrier becomes fatigued such as to deteriorate triboelectric properties. For this reason, the carrier is periodically replaced. In addition, it is necessary to replenish the toner periodically, since it also is consumed.

Thus, in the conventional image forming system, it is necessary to frequently undertake replacement of the carrier and replenishment of the toner. Additionally, it is necessary to replace the image retaining member (photosensitive member), a cleaning member, etc.

Therefore, in order to facilitate maintenance of the image forming system, means have been proposed such as to integrate the replaceable members including expendable supplies or to allow replacement of a recording member (photosensitive member) and replenishment of the toner to be effected simultaneously and at an appropriate timing.

Even when the above-described various improvements have been made, however, it is still necessary to effect replacement of the carrier and replenishment of the toner; therefore, it is not possible to attain a practically maintenance-free developing apparatus.

SUMMARY OF THE INVENTION

Accordingly, it is a primary object of the present invention to provide a developing apparatus which can be used without the need for any inspection practically until the carrier in the developer reaches the end of its predetermined life, thereby to overcome the above-described problems with the prior art.

To this end, according to the invention, there is provided a developing apparatus comprising: a rotatable non-magnetic sleeve retaining a developer formed by mixing a magnetic carrier and a toner; a developer tank disposed inside the non-magnetic sleeve and having a plurality of magnetic poles; a toner tank containing the toner and having a toner outlet communicating with the developer tank and further having a toner replenishing movable member at the toner outlet; and a developer mixing movable member installed inside the developer tank, wherein a predetermined amount of the developer which has previously been adjusted to a predetermined toner density is contained in the developer tank, and the whole of the developing apparatus is abandoned after the magnetic carrier has reached the end of its predetermined life.

The above and other objects, features and advantages of the present invention will become clear from the following description of the preferred embodiments, thereof, taken in conjunction with the accompanying drawings.

DESCRIPTION OF THE PREFERRED EMBODIMENTS

The present invention will be described hereinunder in detail with reference to the accompanying drawings.

Figure 1:
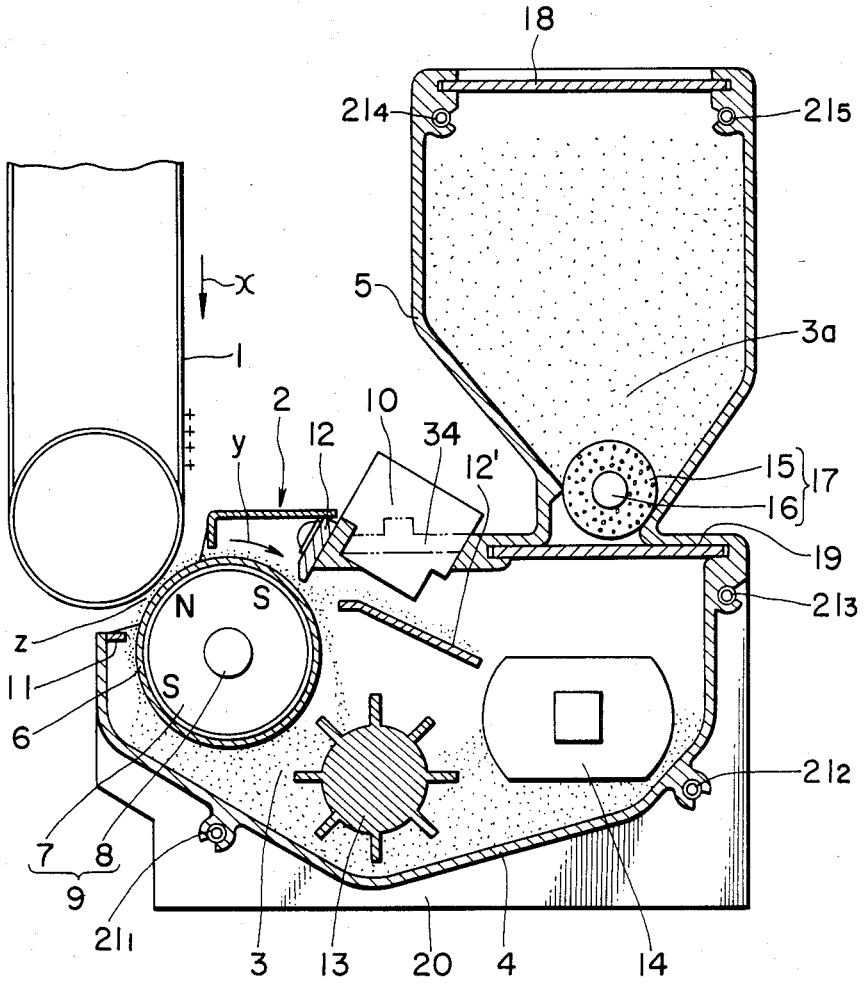
FIGS. 1 and 2 are a sectional view and a side elevational view, respectively, of a developing apparatus in accordance with one embodiment of the invention.
Figure 2:
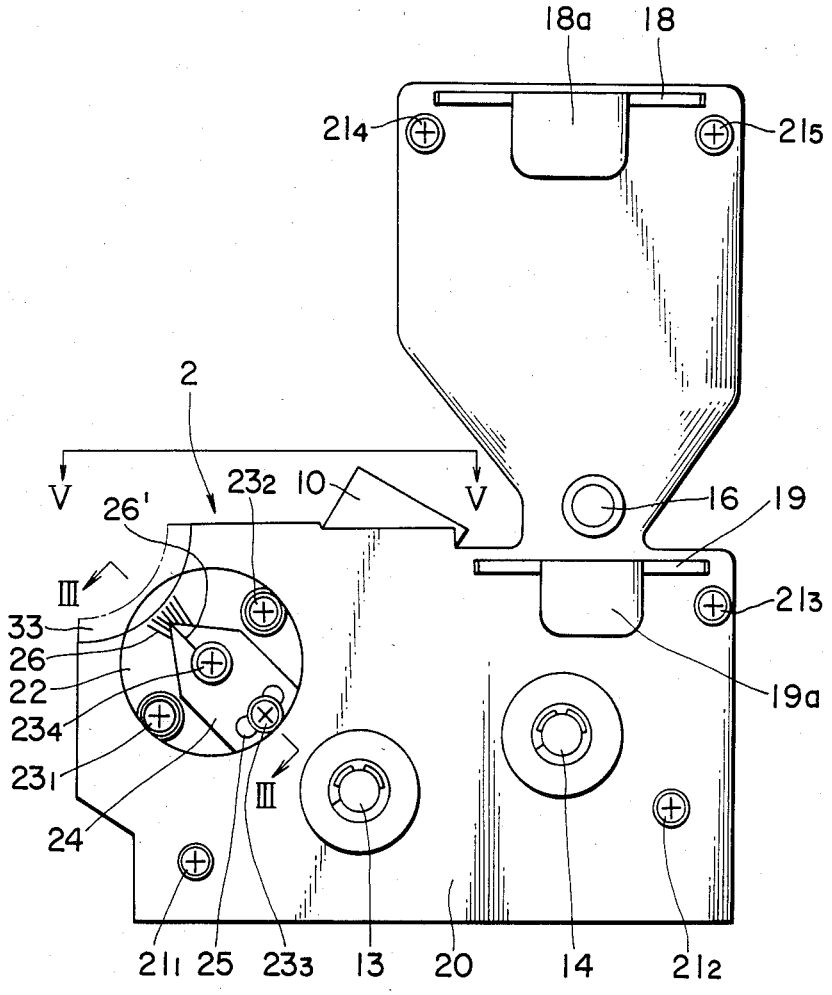

Referring first to FIGS. 1 and 2, a photosensitive belt on a photosensitive drum 1 (not shown in FIG. 2) retaining an electrostatic latent image (denoted by the symbol + in FIG. 1) on the surface thereof moves in the direction of the illustrated arrow X. A developing apparatus 2 has a developer tank 4 containing a developer 3 and a toner tank 5 containing a toner 3*a*. The developer 3 is a mixed powder of a magnetic carrier and a toner. In this case, the toner density of the developer 3 has been previously adjusted to a predetermined value (generally set to be between 3 and 10%). The developer tank 4 is provided therein with a rotatable non-magnetic sleeve 6 which is disposed such as to oppose the photosensitive drum 1. The non-magnetic sleeve 6 is provided therein with a permanent magnet member 9 which is formed by securing to a shaft 8 a permanent magnet 7 having on its surface a plurality of magnetic poles (three, in the case of the illustrated permanent magnet 7). The developer tank 4 is further provided with a toner density detecting member 10 which detects the toner density of the developer 3, a doctor member 11 which regulates the thickness of the developer 3 carried on the non-magnetic sleeve 6, scraper members 12, 12', and mixing rollers 13, 14 for stirring the developer 3. The toner tank 5 has in the bottom portion thereof an opening for discharging the toner 3a. The opening is provided with a toner replenishing roll 17 formed by securing a porous elastic member 15 to be periphery of a shaft 16. Further, partition members 18 and 19 are slidably fitted in the upper and lower ends, respectively, of the toner tank 5. A pair of side panels 20 are fixed to the sides of both the developer tank 4 and the toner tank 5 by means of screws (see the reference numerals $21_1$ to $21_5$ in FIG. 2). It is to be noted that, as shown in FIG. 2, a support member 22 for supporting the permanent member 9 is fixed to the side panel 20 by means of screws $23_1$, $23_2$, and a turning member 24 for turning the shaft 8 is fixed to the support member 22 by means of a screw $23_3$ received in a slot 25. In addition, the reference numerals 26 and 26' denote positioning marks.

Figure 3:
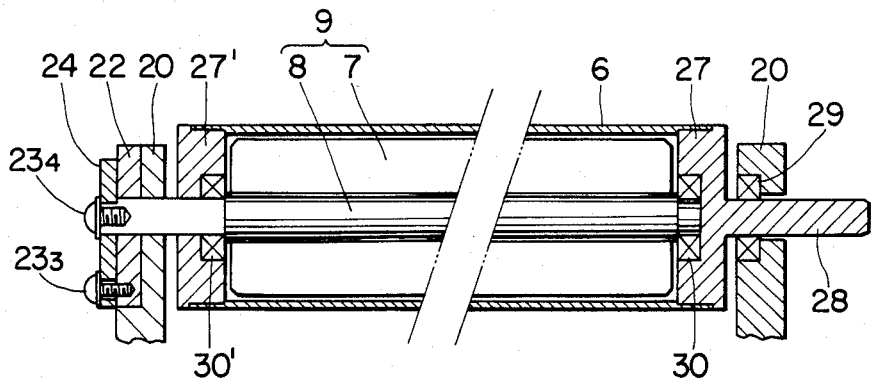
FIG. 3 is a sectional view taken along the line III—III of FIG. 2.

Moreover, the non-magnetic sleeve 6 and the permanent magnet member 9 are supported by the developer tank 4 as shown in FIG. 3. The non-magnetic sleeve 6 has flanges 27 and 27' respectively secured to both ends thereof. One flange 27 has a drive shaft 28, which is supported by one side panel 20 through a bearing 29. The shaft 8 has both ends thereof respectively supported by the flanges 27 and 27' through bearings 30 and 30'. Further, the shaft 8 is fixed to the turning member 24 at the end surface of the shaft 8 which is closer to the flange 27' by means of a screw $23_4$.

With the above-described construction, as the non-magnetic sleeve 6 is rotated in the direction of the illustrated arrow Y, the developer 3 magnetically attached to the surface of the sleeve 6 is carried in the same direction as that of the sleeve 6 such as to brush the surface of the photosensitive drum 1 by means of a magnetic brush formed in a developing region Z thereby to develop the electrostatic latent image on the surface of the photosensitive drum 1 into a visible image. The developer 3 having been used for development is removed from the surface of the sleeve 6 by the scraper members 12, 12' and is subjected to detection of the toner density thereof when passing near the toner density detecting member 10 (it is possible to employ a toner density detecting member such as that mentioned in Japanese Patent Laid-Open Nos. 99,462/84 and 99,463/84). In accordance with the detected toner density, the toner 3a contained in the toner tank 5 is replenished in the developer tank 4 by means of the rotation of the toner replenishing roll 17 (a control circuit for adjusting the toner density is not shown). In this case, it is possible to previously accommodate only a predetermined amount of the toner 3a in the toner tank 5 and to replenish any shortage of toner by the use of a cartridge (not shown). The toner 3 replenished in the developer tank 4 is mixed by means of the rotation of the mixing rollers 13, 14 with the developer 3 scraped by the scaper members 12, 12' and is then magnetically attached to the surface of the non-magnetic sleeve 6 again.

As the result of various investigations of the above-described magnetic brush-type developing apparatus employing a two-component developer made by the present inventor in order to practically eliminate the need for any maintenance and inspection thereof, such a means has been found that, when the magnetic carrier in the developer has reached the end of its predetermined life, the conventional practice wherein the carrier is replaced with a new one is not carried out, but the developing apparatus itself is abandoned and replaced with a new developing apparatus which contains in its developer tank a predetermined amount of developer which has previously been adjusted to a predetermined toner density.

In order to design such a replaceable developing apparatus, it is, as a matter of course, necessary to unitize the developing apparatus as shown in FIG. 1 so that the developing apparatus can be inserted into and drawn out from a reproducing machine in one unit. In addition, the developing apparatus is required to satisfy the following conditions as far as possible.

First of all, since the developing apparatus itself is abandoned, the developing apparatus is required to be manufactured at as low a cost as possible and to be lower in cost than that of the number of copies which can be obtained with one such developing apparatus. To meet this demand, it is suggested that the developer tank 4 and the toner tank 5 shown in FIG. 1 be integrally formed from an organic polymer material such as a plastic by injection molding or other similar technique. Further, in order to reduce the manufacturing cost, it is also effective, as much as possible, to form from plastics the scraper members 12, 12', the mixing rollers 13, 14, the partition members 18, 19 and members (gears, pulleys or the like) for driving the non-magnetic sleeve 6, the mixing rollers 13, 14 and the toner replenishing roller 17. In addition to the above, it is also effective to reduce the diameters of the non-magnetic sleeve 6 and the permanent magnet member 9. In practice, it is preferable to reduce the outside diameter of the non-magnetic sleeve 6 below about 35 mm$\phi$ (more preferably, not greater than 32 mm$\phi$) in the case of an intermediate- or low-speed copying operation.

Figure 4:
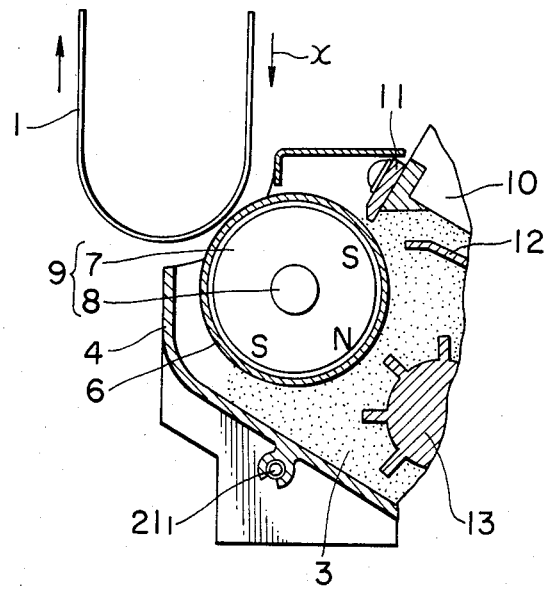
FIG. 4 is a sectional view of a part of the developing apparatus shown in FIG. 1, showing a seal means thereof.

When the developing apparatus is replaced with a new one, the new developing apparatus is required to be usable immediately after it has been incorporated in the reproducing machine without any additional requirement. In other words, it is necessary to arrange the developing apparatus such that even if the developing apparatus is transported in a state wherein it contains therein the toner and the developer having been adjusted to a predetermined toner density, they will not flow out of it. To prevent leakage of the developer which would occur when the developing apparatus is turned upside down, it is suggested that the magnetic attraction force of a permanent magnet be utilized. More specifically, in a developing apparatus employing a two-component developer, it is general for the permanent magnet member to have a plurality of magnetic poles constituted by a magnetic pole for development and magnetic poles for carrying the developer and these magnetic poles are asymmetrically disposed. Accordingly, as shown in FIG. 1, there are no magnetic poles which produce strong magnetic fields on a portion of the surface of the permanent magnet member 9 on the side thereof which is inwards of the developer scraping section (the surface portion of the permanent magnet member 9 between the S-S poles in FIG. 1). For this reason, when the developing apparatus is in its virgin state, with the screw $23_3$ removed and the screw $23_4$ loosened, the turning member 24 is rotated about one half turn (see FIGS. 2 and 3) thereby to move the magnetic poles of the permanent magnet member 9 as shown in FIG. 4 and is fixed at this position by tightening the screws $23_3$ and $23_4$. As shown in FIG. 4, when all the magnetic poles are located on the inner side of the developer tank 4, the developer 3 is magnetically attracted by the magnetic poles on the inner side of the developer tank 4 such as to be magnetically locked, thereby making it possible to prevent leakage of the developer 3 from the opening of the developer tank 4. When the developing apparatus is to be used, it is only necessary to untighten the screws $23_3$ and $23_4$ and to align the mark 26′ on the turning member 24 with the mark 26 on the support member 22 (see FIG. 2) and then to tighten the screws $23_3$ and $23_4$.

Similarly, it is possible to prevent leakage of the toner 3*a* from the toner tank 5 simply by hermetically sealing the upper opening of the toner tank 5 with the partition member 18. In this case, the partition member 18 can be drawn out of the developing apparatus 2 after the latter has been incorporated in the reproducing machine, by pulling a knob 18*a* (see FIG. 2). Moreover, since the developer tank 4 contains the developer 3 which has been adjusted to a predetermined toner density, it is necessary to provide the partition member 19 between the developer tank 4 and the toner tank 5 in order to prevent the developer 3 and the toner 3*a* from being undesirably mixed when the developing apparatus 2 is turned upside down. Also in this case, the partition member 19 can be drawn out of the developing apparatus 2 by pulling a knob 19*a* (see FIG. 2) It is to be noted that peelable seal members may be employed in place of the partition members 18, 19. In such case, if each seal member is folded back on the inner side and a leader portion is provided on the outer side thereof, then it is possible to peel off the seal member very easily and simply by pulling the leader portion even after the developing apparatus 2 has been installed in the reproducing machine.

Figure 5:
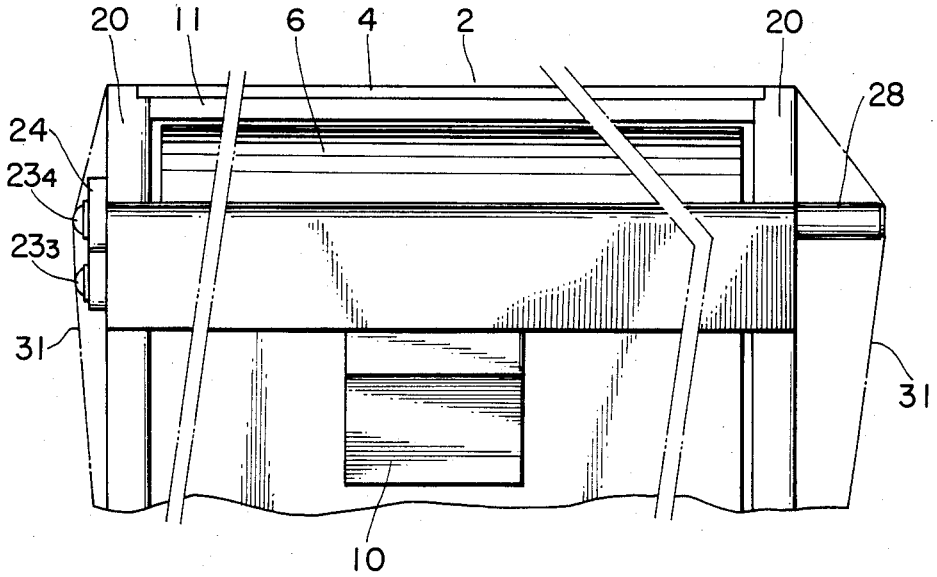
FIG. 5 is an illustration of the developing apparatus as viewed in the direction of the arrow V—V in FIG. 2.

The drive shaft 28 of the non-magnetic sleeve 6 projects out of the side panel 20 of the developing apparatus 2 (see FIG. 5), and moreover, the shaft ends of the mixing rollers 13, 14 and the toner replenishing roller 17 project out of the side panels 20, 20′ of the developing apparatus 2. With these shaft ends left projecting, therefore, there is a strong possibility that the shafts may be undesirably rotated by the reproducing machine operator's inadvertent handling error thus causing various problems. For instance, any rotation of the toner replenishing roller 17 before the use of the developing apparatus 2 causes the toner 3*a* to be replenished in the developer tank 4 which undesirably increases the toner density. To prevent the occurrence of such a problem, it is only necessary to arrange the developing apparatus 2 such that a lock means is provided at each of the above-mentioned shaft ends and is unlocked when use of the developing apparatus 2 is commenced. As the lock means, a mechanical lock mechanism may be employed which is formed by combining a lever, a cam, etc. However, if the developing apparatus 2 is packed or wrapped with a heat-shrinkable synthetic resin film 31 (e.g., polyester film) thereby to fix each of the shaft ends as shown in FIG. 5, then it is possible to lock and unlock each shaft end with ease and at low cost, which is extremely useful. In addition, if the whole of the developing apparatus 2 is wrapped with the synthetic resin film 31, it is possible to seal with the resin film the opening of the developer tank 4 and the upper opening of the toner tank 5, so that the seal members can be omitted.

Moreover, it is necessary to minimize the replacement frequency of the developing apparatus 2 from the viewpoint of copying cost. To satisfy this demand, it is preferable to employ a carrier which has a long life. In practice, employment of a ferrite carrier (e.g., KBN-100, manufactured by Hitachi Metal Ltd.) such as that mentioned in the specification of Japanese Patent Application No. 62,943/82 makes it possible to produce about 100,000 copies per 1 kg of the carrier. Further, since the larger the amount of the developer, the longer life thereof, it is preferable to maximize the capacity of the developer tank 4.

The present invention is not limited to the above-described embodiment but permits the following modification and application thereof.

Figure 6:
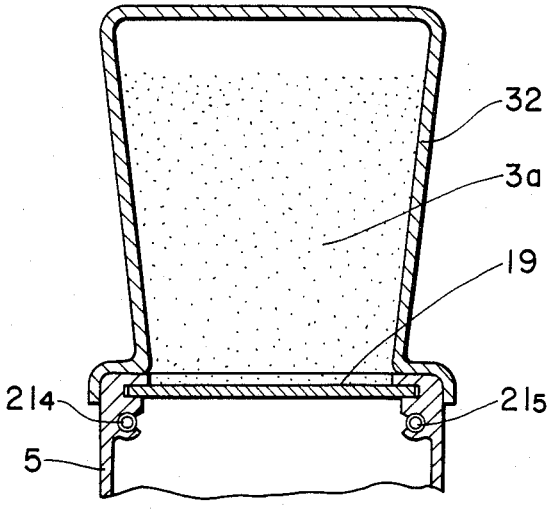
FIG. 6 is a sectional view of a part of a developing apparatus in accordance with another embodiment of the invention.

First of all, it is generally necessary to replenish the toner several tens of times before the carrier reaches the end of its predetermined life, and therefore, it is naturally suggested that the number of times of toner replenishment be reduced in order to decrease the number of maintenance and inspection operations. To reduce the number of times of toner replenishment, it is preferable to provide a spare hopper 32 on the upper portion of the toner tank 5 as shown in FIG. 6. In this case the spare hopper 32 is filled with the toner 3*a* and is sealed at the opening thereof with a peelable seal member (not shown) which is folded back on the inner side and has a leader portion on the outer side and is then mounted on the toner tank 5 as illustrated. By so doing, it is possible to supply the toner 3*a* from the spare hopper 32 into the toner tank 5 simply by pulling the leader portion in order to peel off the seal member.

In place of the spare hopper 32, a detachable toner cartridge (not shown) may be provided on the upper portion of the toner tank 5. As the toner cartridge, it is possible to employ various types of toner cartridge such as those mentioned in Japanese Patent Laid-Open Nos. 96,966/80, 156,859/81 and 211,175/82.

Although the opening of the developer tank 4 is magnetically sealed in the above-described embodiment, the opening may be hermetically sealed with a seal member 33 (shown by the broken line in FIG. 2) of a material excellent in hermetic properties, such as an aluminum foil, such that the seal member 33 can be peeled off when the developing apparatus 2 is installed in the reproducing machine body.

In the developing apparatus employing a two-component developer, it is possible to use various types of toner density detecting member 10 (see Japanese Patent Laid-Open Nos. 117,047/76 and 126,944/78). Since the toner density detecting member 10 is s ill available when the carrier has reached the end of its predetermined life, the number 10 may be removed from the developing apparatus when it is abondoned and may be mounted on a new developing apparatus so as to be used again. In such case, the spare developing apparatus is fitted with a cap 34 (shown by the broken line in FIG. 1) at a position thereon where the toner density detecting member 10 is to be mounted, in order to prevent leakage of the developer 3 as described above, and the cap 34 is removed when the spare developing apparatus is used. However, it is a matter of course that a used developing apparatus may be abandoned with the toner density detecting member 10 mounted thereon in the case where the cost of the member 10 is so low as to account for a very small portion (about several %) of the total cost of the developing apparatus.

Since the developing apparatus of the invention is constructed as described above, when the carrier has reached the end of its predetermined life, the developing apparatus is unloaded from the reproducing machine and is abandoned as it is, or with only the toner density detecting member recovered, and is then replaced by a new developing apparatus which is separately prepared and contains the developer which has previously been adjusted to a predetermined toner density. Thus, a fresh carrier is readily prepared for development. In this case, the developing apparatus may be installed into the reproducing machine after the various above-described lock or seal means have been removed or before a portion of the whole of the lock or seal means removing operation has been carried out.

Thus, according to the present invention, it is possible to obtain a maintenance-free developing apparatus employing a two-component developer and to greatly facilitate the maintenance and inspection of the image forming system incorporating the developing apparatus.

What is claimed is:

1. A developer apparatus capable of being installed into and removed from an electrophotographic recording system as a single unit, said developer unit comprising a developer tank for storing a developer comprising a mixture of magnetic carrier and toner, the toner content of said mixture being set at a predetermined level before said developer apparatus is installed in said electro-photographic recording system;

a toner tank for storing said toner, said toner tank being formed integrally with said developer tank so that the developer apparatus may be installed and removed as a single unit, said toner tank having a toner outlet communicating with said developer tank, a toner replenishing movable member being positioned at said outlet for controlling the flow of toner from said toner tank to said developer tank;

a developer mixing moving member positioned inside said developer tank, a rotatable non-magnetic sleeve for applying said developer to a photoconductive means carrying a latent electrostatic image, said sleeve being positioned in an opening of said developer tank, and a permanent magnetic member disposed in said magnetic sleeve, said permanent magnetic member comprising a plurality of magnetic poles, said developer apparatus further comprising first openable means for sealing the outlet between said toner tank and said developer tank before said developer apparatus is installed in said recording system, second openable sealing means for sealing said opening of said developer tank in which said sleeve is positioned before said developer apparatus is installed in said recording system, and releasable locking means for locking said toner replenishing member, said developer mixing member, and said non-magnetic sleeve prior to installing said development unit to prevent said predetermined level of toner from substantially changing prior to installation of said developer apparatus, so that said developer apparatus may be used immediately upon installation, said developer apparatus being abandoned as a single unit after the magnetic carrier component of said developer has reached the end of its predetermined life.

2. A developer apparatus capable of being installed into and removed from an electro-photographic recording system as a single unit, said developer apparatus comprising a developer tank for storing a developer comprising a mixture of magnetic carrier and toner, the toner content of said mixture being set at a predetermined level before said developer apparatus is installed in said electro-photographic recording system, a toner tank for storing said toner, said toner tank being formed integrally with said developer tank to enable installation of said developer apparatus as a single unit, said toner tank having having a toner outlet communicating with said developer tank, a toner replenishing movable member being positioned at said outlet for controlling the flow of toner from said toner tank to said developer tank, a developer mixing movable member installed inside said developing tank.

a rotatable non-magnetic sleeve for retaining said developer, said sleeve being positioned in an opening of said developer tank, a permanent magnet member disposed in said magnetic sleeve, said magnetic member comprising a plurality of magnetic poles arranged on a portion only of the circumference of said member, said permanent magnetic member being capable of being fixedly positioned so that said poles face the interior of said developer tank before said developer unit is installed in said electrophotographic recording system to prevent the escaping of said developer from inside said developer tank, said poles being rotated to face outside of said developer tank when said developer apparatus is installed to enable developer material to leave said developer tank, openable sealing means for sealing said outlet between said toner tank and said developer tank before said developer apparatus is installed, and releasable lock means for locking said non-magnetic sleeve, said toner replenishing movable member and said developer mixing movable member, before said developer unit is installed as a unit in said electrostatic recording system to prevent said predetermined level of toner from substantially changing prior to installation of said developer appartus, so that said developer apparatus may be used immediately upon installation, said developer apparatus being abandoned as a single unit when said magnetic carrier component of said developer reaches the end of its useful life.

* * * * *